US007118444B2

(12) United States Patent
Newman

(10) Patent No.: US 7,118,444 B2
(45) Date of Patent: Oct. 10, 2006

(54) CUSTOM FIT BRA

(76) Inventor: Joanna M. Newman, 647 E. 11th St., New York, NY (US) 10009-4144

( * ) Notice: Subject to any disclaimer, the term of this patent is extended or adjusted under 35 U.S.C. 154(b) by 31 days.

(21) Appl. No.: 10/639,312

(22) Filed: Aug. 12, 2003

(65) Prior Publication Data

US 2005/0037687 A1 Feb. 17, 2005

(51) Int. Cl.
*A41C 3/02* (2006.01)
*A41C 3/10* (2006.01)

(52) U.S. Cl. ..... 450/58; 450/54

(58) Field of Classification Search ..... 450/54–58, 450/65, 66, 71, 77, 80, 79, 37, 89; 2/267, 2/247, 463, 92

See application file for complete search history.

(56) References Cited

U.S. PATENT DOCUMENTS 1,082,085 A * 12/1913 Keitel ..... 450/54
1,272,427 A * 7/1918 Haderlein ..... 450/37
1,387,586 A * 8/1921 Bradford ..... 450/54
2,706,816 A * 4/1955 Dozier ..... 450/36
2,864,373 A * 12/1958 Buckley ..... 450/57
3,040,750 A * 6/1962 Hurwitz ..... 450/58
3,826,266 A * 7/1974 Alpert ..... 450/11
4,185,332 A * 1/1980 Jahnig ..... 623/7
6,390,885 B1 * 5/2002 Brooks ..... 450/1

* cited by examiner

*Primary Examiner*—Gloria M. Hale
(74) *Attorney, Agent, or Firm*—McCormick, Paulding & Huber LLP

(57) ABSTRACT

A bra includes a first portion having a cup of a first size and a back panel attached to the cup of the first size and a second portion that is separable from the first portion, the second portion having a cup of a second size and a back panel attached to the cup of the second size. The second portion is connectable with the first portion by the connection of the cup of the first size with the cup of the second size and by the connection of the two back panels. In another aspect, a cup for a bra has an inner layer and an outer layer connected to the inner layer to define a pocket therebetween in which a pad can be received, the outer layer being fabricated from an elastic material. In another aspect, a bra-half adapted for cooperation with a second bra-half has a cup of a selected size, a back panel attached to the cup, means disposed on the cup for effecting the connection of the cup to the second bra-half, and means disposed on the back panel for effecting the connection of the back panel to the second bra-half. The cup has an inner layer and an outer layer, the inner layer and the outer layer being connected to each other to define a pocket.

13 Claims, 2 Drawing Sheets

CUSTOM FIT BRA

TECHNICAL FIELD

The present invention relates generally to brassieres (bras), and, more particularly, to a custom fit bra having separable portions, each portion having a cup that is constructed to accommodate different breast sizes and/or shapes.

BACKGROUND OF THE INVENTION

Bras are typically manufactured as unitary pieces having two cups, shoulder straps, and one closure that allows the piece to be closed at either the front or the back of the torso of a person wearing the bra. The designers of such bras erroneously assume that a woman's breasts are both the same size and shape and that, therefore, the cups of these bras need to be manufactured of both the same size and shape. Since the breasts of most women differ by about a half-cup size or more on each side, most bras fail to provide for the proper fit and support of the bustline.

Some bras allow for the insertion and removal of pads in the cups to compensate for visual differences in breast sizes. Because of the way in which these pads are inserted, however, the breast is simply forced up without altering the size of the cup to allow the breast to fit correctly or comfortably therein. Furthermore, these pads typically create a noticeable change in the bustline. Women aware of such a noticeable change oftentimes feel self conscious and less confident in their daily encounters.

Based on the foregoing, it is the general object of the present invention to provide a bra that overcomes or improves upon the prior art.

SUMMARY OF THE INVENTION

The present invention is directed in one aspect to a bra having a first portion having a cup of a first size and a back panel attached to the cup of the first size and a second portion that is separable from the first portion, the second portion having a cup of a second size and a back panel attached to the cup of the second size. The second portion is connectable with the first portion by the connection of the cup of the first size with the cup of the second size and by the connection of the two back panels.

The invention is directed in another aspect to a cup for a bra wherein the cup has an inner layer and an outer layer connected to the inner layer to define a pocket therebetween in which a pad can be received, the outer layer being fabricated from an elastic material.

In yet another aspect, the invention is directed to a bra-half adapted for cooperation with a second bra-half in which the bra-half has a cup of a selected size, a back panel attached to the cup, means disposed on the cup for effecting the connection of the cup to the second bra-half, and means disposed on the back panel for effecting the connection of the back panel to the second bra-half. The cup has an inner layer and an outer layer, the inner layer and the outer layer being connected to each other to define a pocket.

One advantage of a bra having two separable portions is that each portion of the bra can be sold separately and fitted for different cup sizes. Because many women require cup sizes that differ by a half size or more, use of the custom fit bra of the present invention would enable those women to purchase each cup of the bra and to assemble the bra based on their own particular needs in order to attain a proper fit.

Thus, because the fit of the bra would not be compromised by the difference in breast sizes, the wearer would gain an increased level of confidence from the knowledge that her bust is properly supported. Furthermore, the insertion of a pad into a pocket in one or both cups that are sized to fit properly and comfortably would enable uniformity in size to be established, thereby giving the wearer an even greater level of confidence from the knowledge that her bustline has a symmetrical appearance.

Another advantage of the two portion bra is that one or both cups of the bra can be fitted with prostheses. Because the outer layer of each cup is fabricated from an elastic material, a prosthetic breast can be disposed in one or both of the pockets. Any differences in sizes between the breasts can be corrected using pads. Thus, the wearer of the bra in which a prosthetic device is fitted can likewise gain an increased level of confidence from the knowledge that her bust is properly supported and that her bustline has a symmetrical appearance.

DETAILED DESCRIPTION

Figure 1:
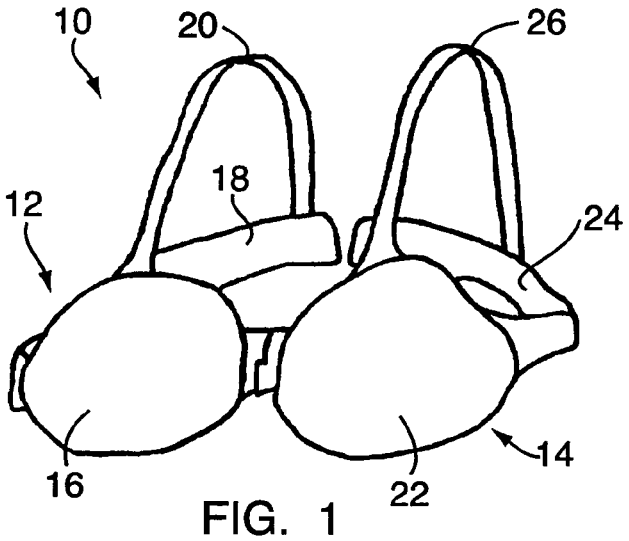
FIG. 1 is a perspective view of a bra having two separable portions.

Referring to FIG. 1, a bra having separable portions is shown generally at 10. As shown, the bra 10 includes a first portion 12 (a first bra-half) and a second portion 14 (a second bra-half), the first portion 12 being connectable and adaptable for cooperation with the second portion 14 such that, when the bra 10 is worn in a conventional fashion on the torso of a person, the first portion 12 and the second portion 14 are connected to each other at the front, preferably between the breasts, and in the back, preferably at about the center of the person's back.

The first portion 12 includes a cup 16, a back panel 18 attached to the cup 16, and associated hardware such that the second portion 14 can be connected thereto. The first portion 12 preferably also includes a shoulder strap 20 that extends from the cup 16 to the back panel 18. The second portion 14 likewise includes a cup 22, a back panel 24 attached to the cup 22, (preferably) a shoulder strap 26, and associated receiving hardware that allows for the direct connection of the second portion 14 to the first portion 12. The shoulder straps 20, 26 are optional, as the cups 16, 22 may be configured with wire or plastic substructures that allow the breasts of the person wearing the bra 10 to be supported from below, thereby enabling the bra 10 to be worn with sleeveless garments. The back panels 18, 24 may be integrally formed with their respective cups 16, 22 (e.g., as single piece elements). The cups 16, 22, back panels 18, 24, and shoulder straps 20, 26 can be fabricated from any conventional material that provides comfort to the wearer of the bra 10. Furthermore, materials of fabrication can be used that provide an aesthetic appeal to the bra 10.

Figure 2:
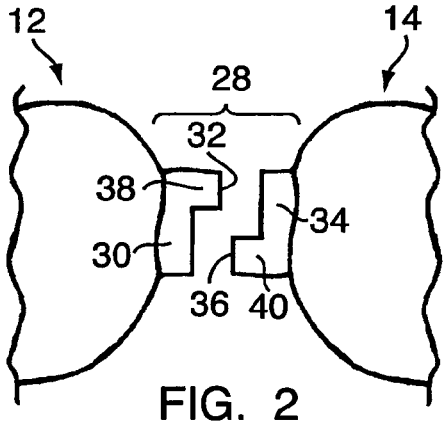
FIG. 2 is a view of a clasp used to connect separable portions of a bra at the front.

Referring now to FIG. 2, one exemplary embodiment of the hardware associated with the connection of the first portion 12 and the second portion 14 at the front of the bra 10 is shown. Such hardware is a clasp 28 that includes cooperating halves, each half being connected to its respective first portion 12 or second portion 14. The half connected to the first portion 12, which is shown at 30, includes a protrusion 32, and the half connected to the second portion 14, which is shown at 34, includes a protrusion 36. The cooperating halves are "twisted" together such that structures on a front face 38 of the protrusion 32 cooperatively engage mating structures on a rear face (not shown) on the cooperating half 34 and structures on a front face 40 of the protrusion 36 cooperatively engage mating structures on a rear face (not shown) on the cooperating half 30. Other embodiments of the hardware by which each portion 12, 14 may be interconnected include, but are not limited to, locking tongue-and-eye structures, hooks, hooks and eyelets, hook-and-loop material, and the like.

Figure 3:
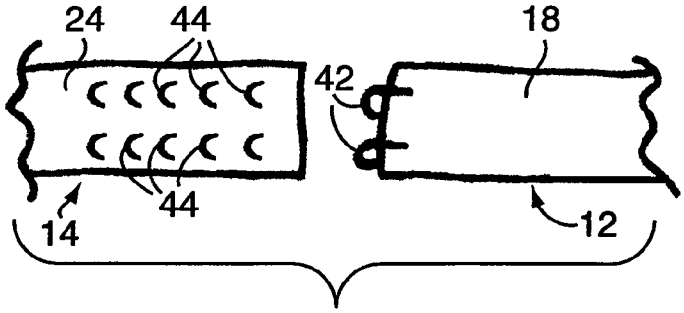
FIG. 3 is a view of an arrangement of hooks and eyelets used to connect separable portions of a bra at the back.

One exemplary embodiment by which the connection of the portions 12, 14 may be effected in the back is an arrangement of hooks 42 and eyelets 44, as is shown with reference to FIG. 3. Hooks 42 are mounted on the back panel 18 of the first portion 12, and the corresponding eyelets 44 are mounted on the back panel 24 of the second portion 14. Although the first portion 12 is shown as having two hooks 42 adjacently positioned so as to allow for their engagement with two corresponding eyelets 44, it should be understood that any number of hooks 42 may be coupled to the first portion 12 to be engagable with any number of corresponding eyelets 44. Generally, as the size of the bra increases, the number of hooks 42 increases. Furthermore, a plurality of eyelets 44 are arranged in a row, each eyelet 44 in the row being positioned so as to allow the bra to be adjustably fit to the torso of the person wearing the bra when the hooks 42 and the eyelets 44 are interengaged. Although five eyelets 44 are shown as being disposed in each row, it should be understood that any number of eyelets 44 may be disposed in each row to be engagable with a corresponding hook 42.

Figure 4:
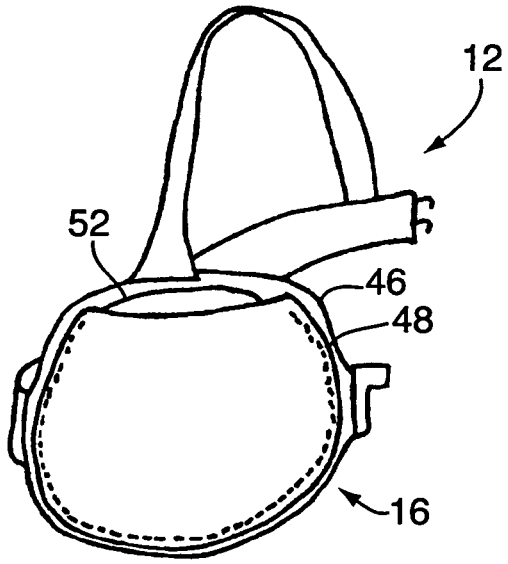
FIG. 4 is a perspective view of one cup of a separable portion bra showing a pocket in which a pad is inserted.

Referring now to FIG. 4, the first portion 12 and, more particularly, the first cup 16 are shown in detail. The first cup 16 has an inner layer 46 that contacts the body of the person wearing the bra and an outer layer 48 disposed in facial engagement wit the inner layer 46 and connected to the inner layer 46 (preferably by stitching) substantially along a portion of the peripheral edge of each layer 46, 48 to define a pocket. The outer layer 48 is preferably formed of an elastic material so as to conform to the natural shape of a breast held by the cup 16 and so as to not alter the fit of the bra on the wearer. The pocket is configured as shown in FIG. 4 with an outside opening at the top to receive a pad 52 or a prosthesis therein. Exemplary embodiments of pads 52 include, but are not limited to, sealed bags having fluids, semi-fluids, or gels disposed therein or members fabricated from elastomeric materials (e.g., sponge rubbers), cloth, felts, plastics, and the like.

Figure 5:
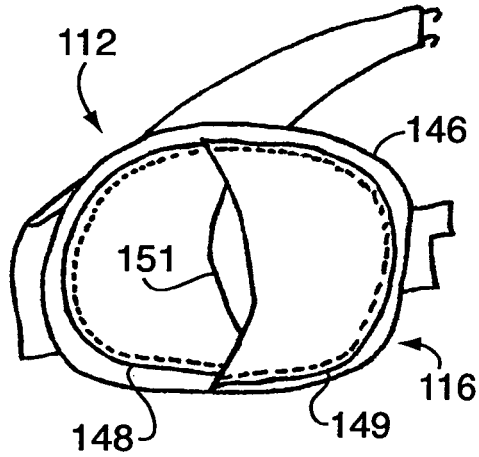
FIG. 5 is a perspective view of an alternate embodiment of one cup of a separable portion bra showing a pocket.

In an alternate embodiment, as is shown with reference to FIG. 5, a pocket disposed in a first cup 116 of a first portion 112 of a bra may be defined by a first outer layer 148 and a second outer layer 149, each being connected to an inner layer 146 so as to form an opening that extends substantially across the center of the outside of the first cup 116. In such an embodiment an edge 151 of the first outer layer 148 at which the opening is defined may be disposed under the second outer layer 149 such that the second outer layer 149 can be pulled back to expose the opening through which the pad is to be inserted. Such a configuration facilitates the retaining of the pad in the pocket and prevents its inadvertent removal.

Figure 6:
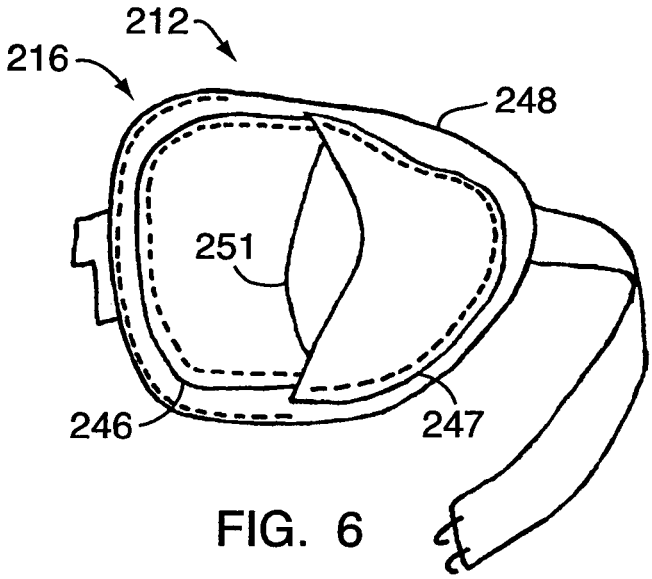
FIG. 6 is a perspective view of a cup of a separable portion bra in which a pocket is disposed on the inside of the cup.

In another alternate embodiment, as is shown with reference to FIG. 6, a pocket disposed in a first cup 216 of a first portion 212 of a bra may be defined by a first inner layer 246 and a second inner layer 247, each being connected to an outer layer 248 so as to form an opening that extends substantially across the center of the first cup 216 but on the inside of the first cup 216. In a manner similar to that as described above, an edge 251 of the first inner layer 246 at which the opening is defined may be disposed under the second inner layer 247 such that the second inner layer 247 can be pulled back to expose the opening through which the pad is inserted. Such a configuration, because the opening is held against the breast of the wearer, even further facilitates the retaining of the pad in the pocket.

It should be understood by those of skill in the art that the second cup disposed on the second portion of the bra in any of the above embodiments is of a construction that is substantially identical in structure to the first cup disposed on the first portion. Such second cups, however, preferably vary in size to accommodate different size breasts of the wearer.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims

What is claimed is:

1. A bra, comprising:

a first portion having a first cup of a first size and a first back panel attached to said first cup, said first cup comprising a first inner layer of said first size and a first outer layer, said first inner layer and said first outer layer being connected to each other substantially along a portion of the peripheral edge of each of said first inner layer and said first outer layer to define a first pocket with a first opening on the outside of said first cup, and a first shoulder strap attached to said first cup and said first back panel;

a second portion separable from said first portion and having a second cup of a second size and a second back panel attached to said second cup said second cup comprising a second inner layer of said second size and a second outer layer, said second inner layer and said second outer layer being connected to each other substantially along a portion of the peripheral edge of each of said second inner layer and said second outer layer to define a second pocket with a second opening on the outside of said second cup; and a second shoulder strap attached to said second cup and said second back panel; and said second portion being connectable with said first portion by a front releasable connection of said first cup with said second cup and by the connection of said first back panel with said second back panel.

2. The bra of claim 1, further comprising a clasp for effecting the front releasable connection of said first cup with said second cup, said clasp comprising cooperating halves having matingly engagable structures disposed on each half.

3. The bra of claim 1, further comprising a hook and eyelet arrangement for effecting the back releasable connection of said first back panel with said second back panel, said hook and eyelet arrangement comprising at least one hook disposed on said first back panel and at least one eyelet disposed on said second back panel.

4. The bra of claim 1, wherein said first outer layer and said second outer layer are each fabricated from an elastic material.

5. The bra of claim 1, further comprising a pad inserted in at least one of said first pocket and said second pocket.

6. The bra of claim 1, wherein said first cup comprises a first inner layer and two first outer layers connected to said first inner layer such that said first opening extends substantially across the center of said first cup, and wherein said second cup comprises a second inner layer and two second outer layers connected to said second inner layer such that said second opening extends substantially across the center of said second cup.

7. The bra of claim 6, wherein said two first outer layers and said two second outer layers are each fabricated from an elastic material.

8. The bra of claim 6, further comprising a pad inserted in at least one of said first pocket and said second pocket.

9. A bra-half, adapted for cooperation with a second bra-half comprising:

a cup being of a selected size, said cup comprising, an inner layer of said selected size and an outer elastic layer, said inner layer and said outer layer being connected to each other to define a pocket with an opening on the outside of said cup;

a back panel attached to said cup;

front releasable connection means disposed on said cup for effecting the connection of said cup to said second bra-half; and back releasable connection means disposed on said back panel for effecting the connection of said back panel to said second bra-half.

10. The bra-half of claim 9, further comprising a pad inserted in said pocket.

11. The bra-half of claim 9, wherein said inner layer and said outer layer are connected to each other substantially along a portion of a peripheral edge of each of said inner layer and said outer layer to define said pocket.

12. The bra-half of claim 9, wherein said outer layer comprises a first outer layer and a second outer layer, said first outer layer and said second outer layer connected to said inner layer such that an opening extends substantially across the center of said cup.

13. The bra-half of claim 12, wherein said first outer layer and said second outer layer are fabricated from an elastic material.

* * * * *

UNITED STATES PATENT AND TRADEMARK OFFICE

CERTIFICATE OF CORRECTION

PATENT NO. : 7,118,444 B2
APPLICATION NO. : 10/639312
DATED : October 10, 2006
INVENTOR(S) : Joanna M. Newman It is certified that error appears in the above-identified patent and that said Letters Patent is hereby corrected as shown below:

On The Title Page, Item (57) Abstract

A bra for breasts of differing sizes or shapes includes a first portion having a cup of a first size and a back panel attached to the cup and a second portion that is separable from the first portion, the second portion having a cup of a second size and a back panel attached to the cup. The second portion is connectable with the first portion in front by a releasable front connection of the cups and connectable in the back by a releasable back connection of the two back panels. Each of the cups has an inner layer and an outer layer connected to the inner layer to define a pocket there between in which a pad can be received, the outer layer being fabricated from an elastic material.

Signed and Sealed this

Second Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,118,444 B2
APPLICATION NO. : 10/639312
DATED : October 10, 2006
INVENTOR(S) : Joanna M. Newman It is certified that error appears in the above-identified patent and that said Letters Patent is hereby corrected as shown below:

On The Title Page, Item (57) Abstract should read
--A bra for breasts of differing sizes or shapes includes a first portion having a cup of a first size and a back panel attached to the cup and a second portion that is separable from the first portion, the second portion having a cup of a second size and a back panel attached to the cup. The second portion is connectable with the first portion in front by a releasable front connection of the cups and connectable in the back by a releasable back connection of the two back panels. Each of the cups has an inner layer and an outer layer connected to the inner layer to define a pocket there between in which a pad can be received, the outer layer being fabricated from an elastic material.--.

Signed and Sealed this

Sixteenth Day of October, 2007

JON W. DUDAS
*Director of the United States Patent and Trademark Office*